US006454425B1

(12) United States Patent
Lin

(10) Patent No.: US 6,454,425 B1
(45) Date of Patent: Sep. 24, 2002

(54) CANDLE SIMULATING DEVICE HAVING LIGHTING DEVICE

(75) Inventor: Yu Chuan Lin, Chong Ho (TW)

(73) Assignee: Superstar Lighting Co., Ltd., Taipei (TW)

( * ) Notice: Subject to any disclaimer, the term of this patent is extended or adjusted under 35 U.S.C. 154(b) by 0 days.

(21) Appl. No.: 09/901,089

(22) Filed: Jul. 10, 2001

(51) Int. Cl.[7] ..... F21V 33/00
(52) U.S. Cl. ..... 362/96; 362/806
(58) Field of Search ..... 362/96, 253, 294, 362/373, 806; 40/412, 427, 428, 431, 436, 439, 441; 392/348; 472/65

(56) References Cited

U.S. PATENT DOCUMENTS 1,824,388 A * 9/1931 Birch ..... 40/428
4,965,707 A * 10/1990 Butterfield ..... 40/428
6,312,137 B1 * 11/2001 Hsieh ..... 362/96

* cited by examiner

*Primary Examiner*—Y. My Quach-Lee

(57) ABSTRACT

A candle simulating device includes a blowing device for generating an air and for directing the air toward a flame-like flexible member, in order to blow and to oscillate or to vibrate the flame-like flexible member and to simulate a candle. The blowing device includes a fan-and-motor device received in an enclosure for generating the air through a mouth. A light device may be attached to the enclosure and directed toward and to light the flame-like flexible member. A lamp shade may direct the light generated by the light device toward the flame-like flexible member.

7 Claims, 5 Drawing Sheets

CANDLE SIMULATING DEVICE HAVING LIGHTING DEVICE

BACKGROUND OF THE INVENTION

1. Field of the Invention

The present invention relates to a candle, and more particularly to a candle simulating device having a blowing and a lighting devices.

2. Description of the Prior Art

Typical candles are required to be ignited with lighters or the like, and include a flame that may cause fires and the other hazardous disasters inadvertently. The flames may be easily extinguished by the air flowing through the candles. In addition, the materials for forming the candles may be melted and may flow downward and may hurt people inadvertently, and may also cause fires and the other hazardous disasters inadvertently.

The present invention has arisen to mitigate and/or obviate the afore-described disadvantages of the conventional candles.

SUMMARY OF THE INVENTION

The primary objective of the present invention is to provide a candle simulating device including a flame-like member that may be blown and/or lighted for simulating the candle, without actually burning the candles.

In accordance with one aspect of the invention, there is provided a candle simulating device comprising a flame-like flexible member, and a blowing device for generating an air, and including a mouth directed toward the flame-like flexible member for directing the air toward and to blow and to oscillate or to vibrate the flame-like flexible member in order to simulate a candle.

The blowing device includes an enclosure, and a fan-and-motor device received in the enclosure for generating the air through the mouth.

A housing is further provided, and means for supporting the flame-like flexible member in the housing, the blowing device being disposed in the housing and disposed below the flame-like flexible member for generating the air to blow the flame-like flexible member.

The supporting means includes a plate secured in the housing and having an opening formed therein, the flame-like flexible member is supported above the opening of the plate.

The supporting means includes a socket device disposed on the plate, and a seat secured on the socket device and having the flame-like flexible member attached thereto.

A device is further provided for lighting the flame-like flexible member and includes a light device directed toward the flame-like flexible member for generating a light to light the flame-like flexible member. The blowing device includes an enclosure, and a retainer provided on the enclosure for supporting the light device. The flame-like flexible member preferably includes a red or an orange or a flame simulating color or pattern applied thereon for simulating the flame of the candle.

The plate includes an orifice formed therein for receiving the light device. A device is further provided for directing the light generated by the light device toward the flame-like flexible member, and includes a lamp shade disposed on the plate and disposed above the light device for directing the light generated by the light device toward the flame-like flexible member.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
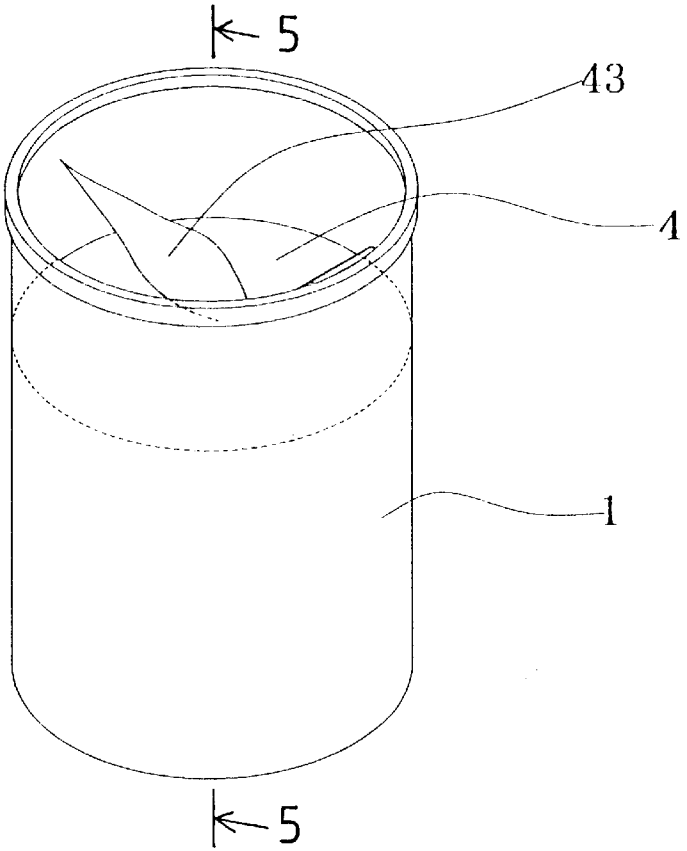
FIG. 1 is a perspective view of a candle simulating device in accordance with the present invention.
Figure 3:
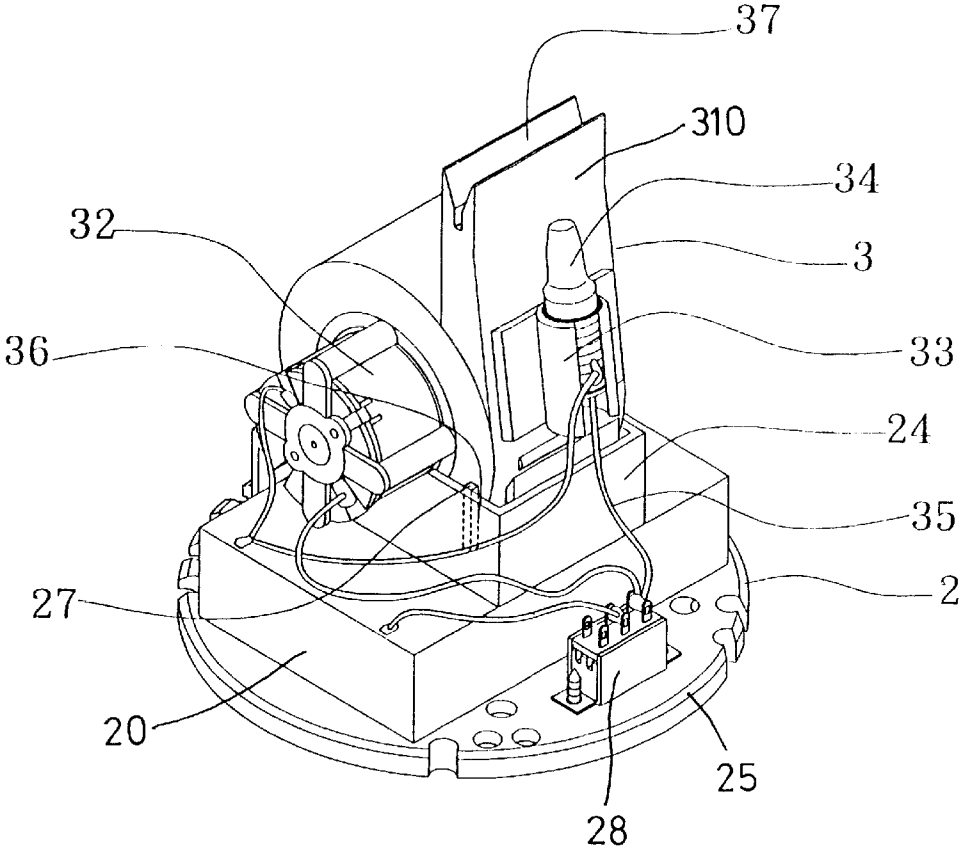
FIG. 3 is a partial perspective view of the candle simulating device, in which the outer housing has been removed for showing the inner structure of the candle simulating device.
Figure 2:
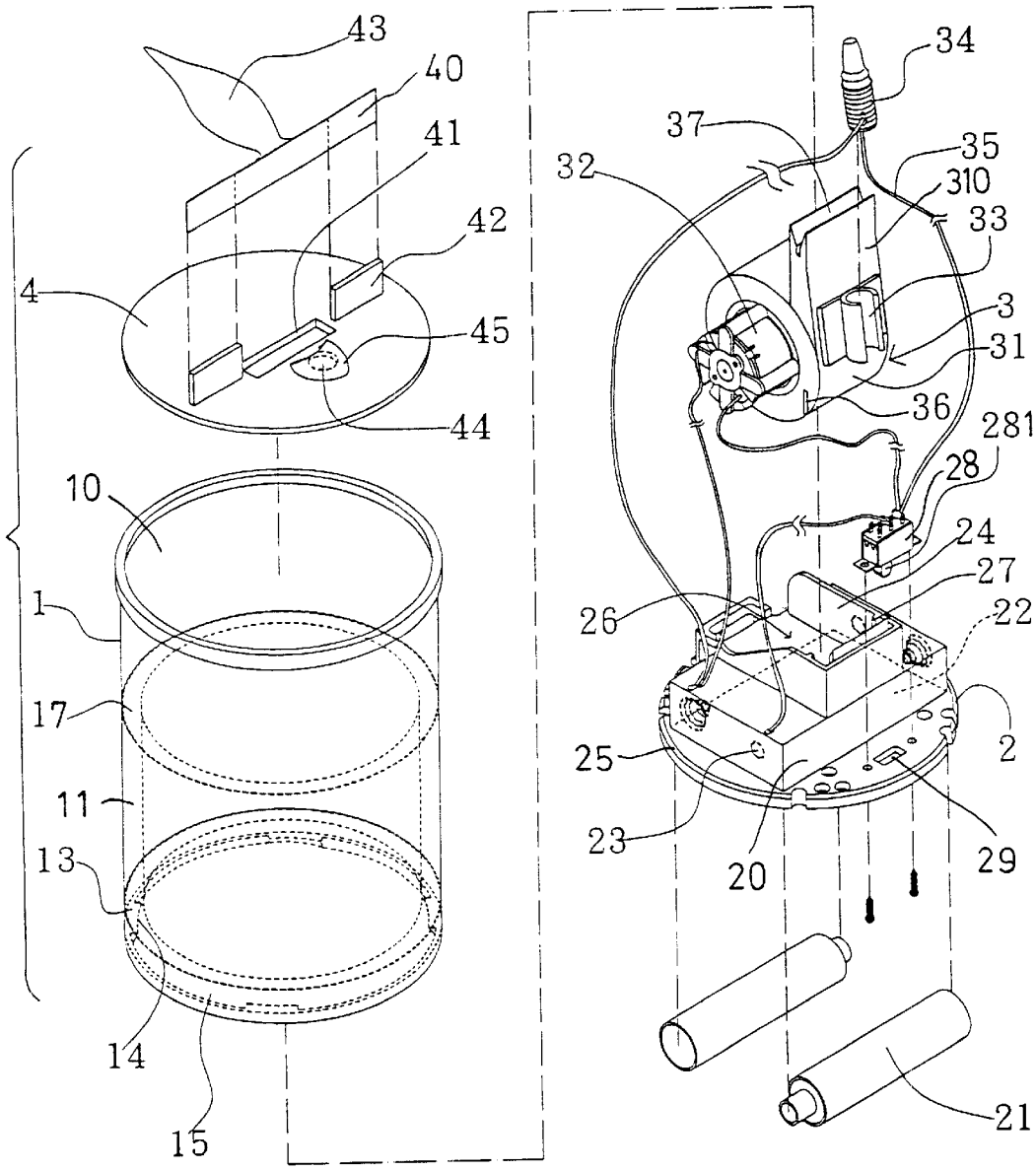
FIG. 2 is an exploded view of the candle simulating device.
Figure 4:
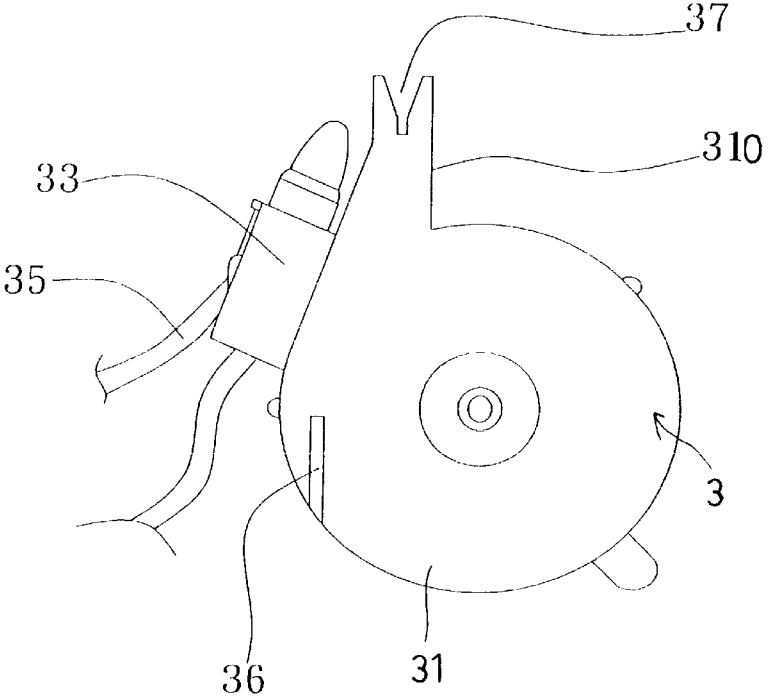
FIG. 4 is a partial plane view illustrating the blowing device and the lighting device of the candle simulating device.
Figure 5:
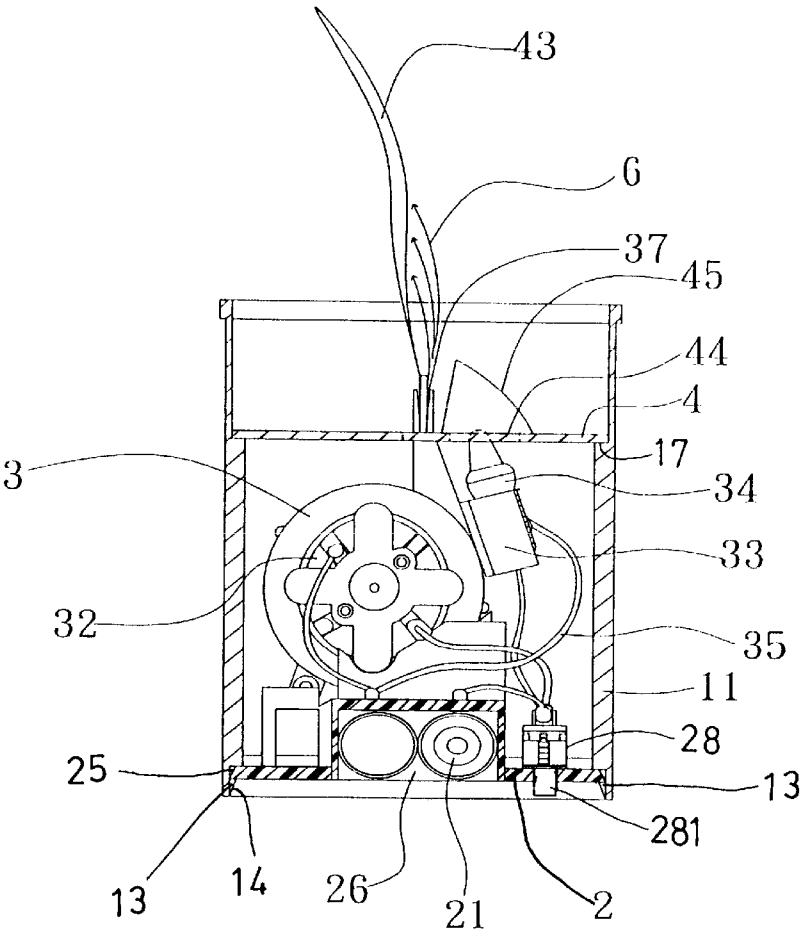
FIG. 5 is a cross sectional view taken along lines 5—5 of FIG. 1.

Referring to the drawings, and initially to FIGS. 1–5, a candle simulating device in accordance with the present invention comprises a housing 1 including a chamber 10 formed therein, and including a peripheral bulge 11 extended radially inward of the chamber 10 of the housing 1 for forming or defining a peripheral shoulder 17 in the upper portion thereof and for forming a peripheral recess 15 in the lower portion thereof. The housing 1 includes one or more latches 13 extended inward of the peripheral recess 15 thereof and each having an inclined surface 14 formed therein.

A plate 4 is engaged on the peripheral shoulder 17 of the housing 1, and includes an opening 41 formed therein, and includes two sockets 42 provided beside the opening 41 thereof, and includes an orifice 44 formed therein and located beside the opening 41 thereof, and includes a shield or lamp shade 45 provided above the orifice 44 thereof. A seat 40 has two ends secured in the sockets 42, and includes a flame-like flexible member 43 attached thereto and having a flame-like shape. The flame-like flexible member 43 may be oscillated or vibrated relative to the seat 40 and is preferably applied with orange or red or flame-like colors thereon for simulating the flames.

A base 2 may be engaged into the peripheral recess 15 of the housing 1, and includes a peripheral inclined or tapered surface 25 formed thereon for engaging with the inclined surfaces 14 of the latches 13 and for allowing the base 2 to be engaged into the peripheral recess 15 of the housing 1. The latches 13 may be engaged with the base 2 for securing the base 2 in the bottom of the housing 1. The base 2 includes a receptacle 20 formed or provided thereon and facing downward for receiving one or more batteries 21 therein, and includes one or more conductors 23 attached thereto and electrically engaged with the center and/or case electrodes of the batteries 21. The base 2 includes a slot 29 formed therein and located beside the receptacle 20.

Figure 6:
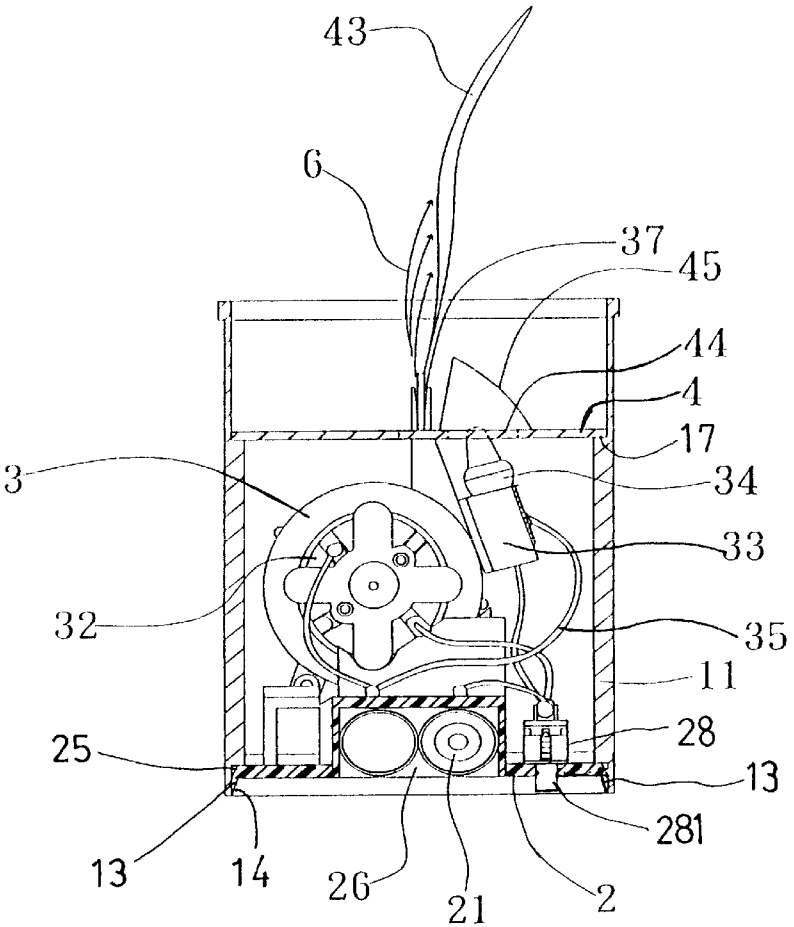
FIGS. 6, 7 are cross sectional views similar to FIG. 5, illustrating the operation of the candle simulating device.

A casing 24 is formed or provided or disposed on top of the receptacle 20, and includes a space 26 formed therein, and includes one or more ribs 27 formed or extended therefrom. A blowing device 3 includes an enclosure 31 having one or more grooves 36 formed therein for receiving the ribs 27 and for securing the blowing device 3 in the casing 24 with such as a force-fitted engagement or the like, and having a mouth 310 extended upward therefrom and located below the opening 41 of the plate 4. The mouth 310 includes an opening 37 formed therein and directed toward the opening 41 of the plate 4 for directing the air to flow through the opening 41 of the plate 4. A motor-driven fan device or a fan-and-motor device 32 is disposed in the enclosure 31 of the blowing device 3 for generating an air 6 (FIGS. 5, 6) through the mouth 310 and the opening 41 of the plate 4, in order to blow the flame-like flexible member 43.

Figure 7:
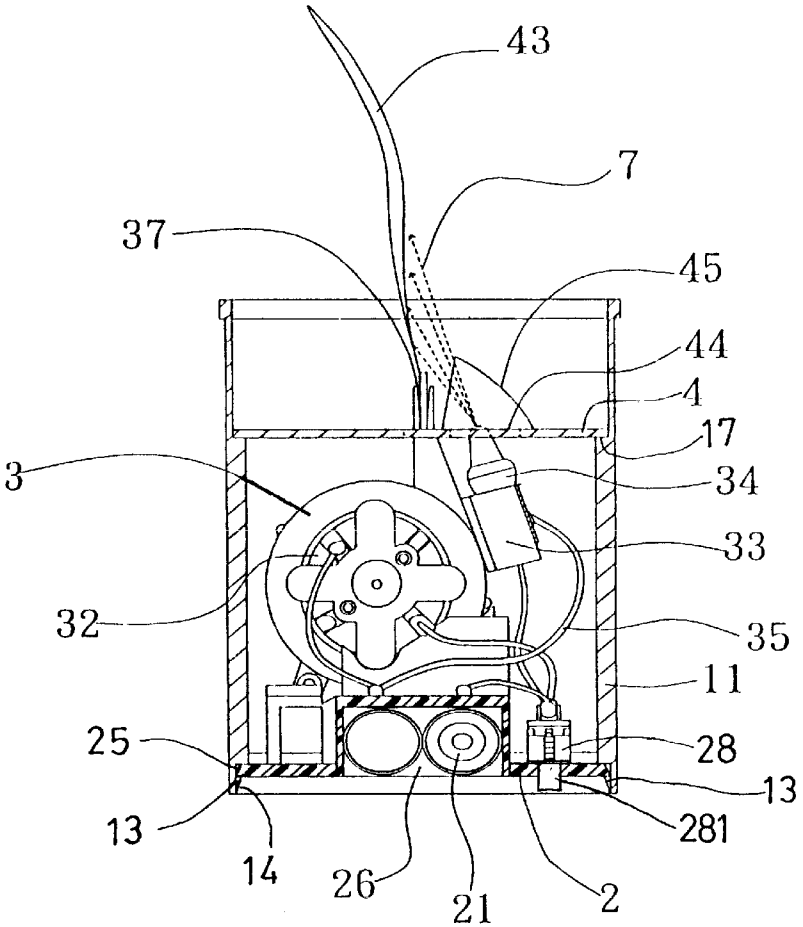

A retainer 33 is formed or provided or attached to the enclosure 31 of the blowing device 3 for supporting one or more light devices or light bulbs 34 therein. The light device 34 is directed toward the orifice 44 of the plate 4 for generating a light to light the flame-like flexible member 43 (FIG. 7). The lamp shade 45 may direct the light toward the flame-like flexible member 43 and may prevent the light from emitting toward the other directions. The batteries 21 are electrically coupled to the fan-and-motor device 32 and/or to the light device 34 with electric wires 35 and a switch device 28 which includes a switch button 281 extended outward through the slot 29 of the base 2, such that the fan-and-motor device 32 and the light device 34 may be actuated or energized by the switch button 281 of the switch device 28.

Figure 8:
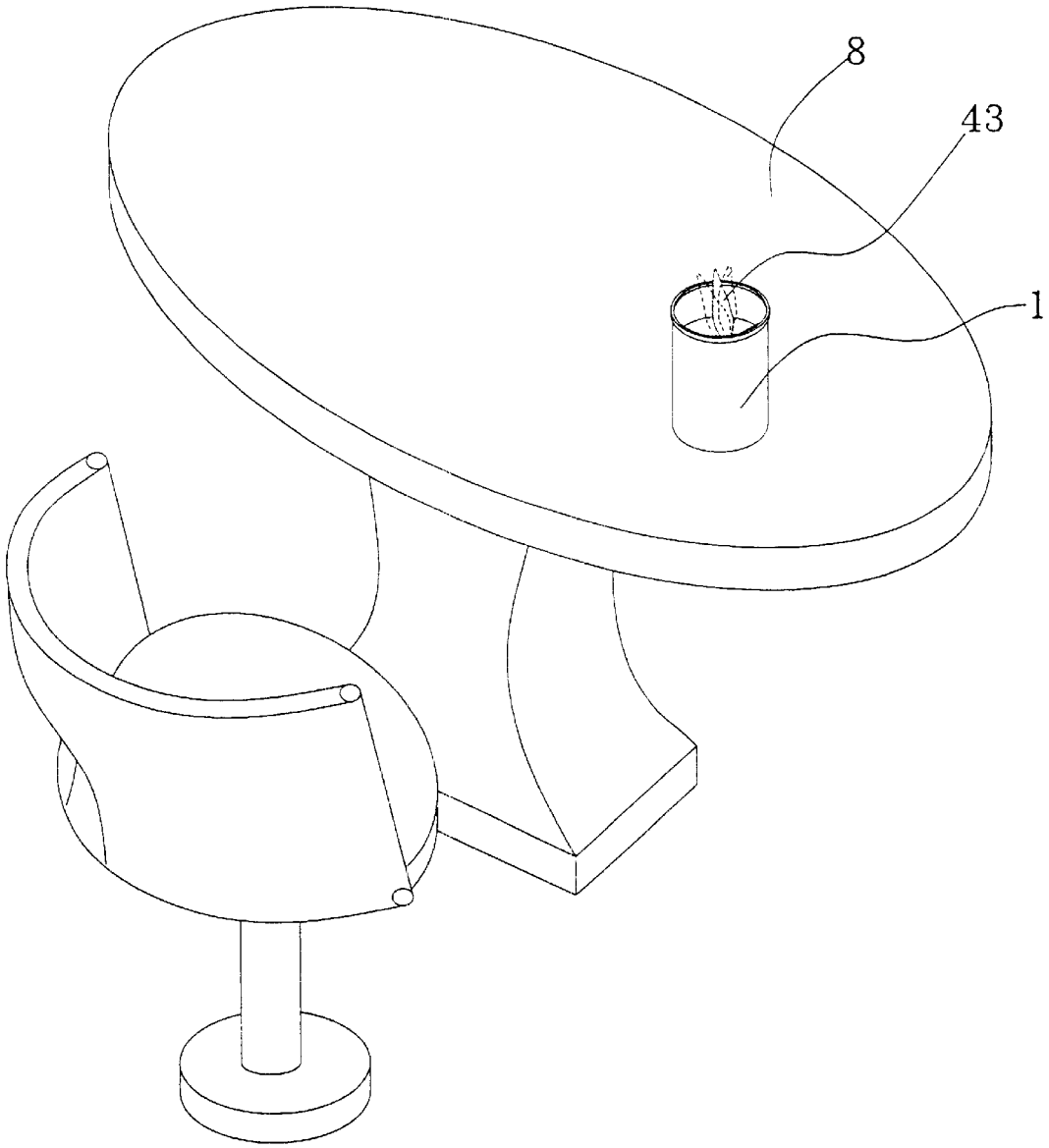
FIG. 8 is a perspective view illustrating the operation of the candle simulating device.

In operation, as shown in FIG. 8, the candle simulating device in accordance with the present invention may be disposed on top of any kind of supporting surfaces 8. The flame-like flexible member 43 may be blown or oscillated or vibrated by the air 6 generated by the fan-and-motor device 32, and may be lighted by the light device 34, in order to simulate the candle, without actually burning the candles.

Accordingly, the candle simulating device in accordance with the present invention includes a flame-like member that may be blown and/or lighted for simulating the candle, without actually burning the candles.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A candle simulating device comprising:

a housing, a plate secured in said housing, and including an orifice formed therein, a flame-like flexible member supported on said plate, a light device received in said orifice of said plate, and directed toward said flame-like flexible member for generating a light to light said flame-like flexible member, and a blowing device including a mouth directed toward said flame-like flexible member for generating an air and for directing the air toward and to blow said flame-like flexible member.

2. The candle simulating device according to claim 1, wherein said blowing device includes an enclosure having said mouth provided thereon, and a fan-and-motor device received in said enclosure for generating the air through said mouth.

3. The candle simulating device according to claim 2, wherein said blowing device includes a retainer provided on said enclosure for supporting said light device.

4. The candle simulating device according to claim 1, wherein said blowing device is disposed in said housing and disposed below said flame-like flexible member for generating the air to blow said flame-like flexible member.

5. The candle simulating device according to claim 1, wherein said plate includes an opening formed therein, said flame-like flexible member is supported above said opening of said plate.

6. The candle simulating device according to claim 1, wherein said plate includes a socket device disposed thereon, and a seat secured on said socket device and having said flame-like flexible member attached thereto.

7. The candle simulating device according to claim 1 further comprising a lamp shade disposed on said plate and disposed above said light device and directed toward said flame-like flexible member for directing the light generated by said light device toward said flame-like flexible member.

* * * * *